US012071954B1

(12) United States Patent
Ledford

(10) Patent No.: US 12,071,954 B1
(45) Date of Patent: Aug. 27, 2024

(54) AERATION PUMP SYSTEM WITH A 90-DEGREE ELBOW BETWEEN AN INLET AND AN OUTLET

(71) Applicant: Turtle Pump Company LLC, Florissant, CO (US)

(72) Inventor: Gary Alan Ledford, Florissant, CO (US)

(73) Assignee: TURTLE PUMP COMPANY LLC, Florissant, CO (US)

( * ) Notice: Subject to any disclaimer, the term of this patent is extended or adjusted under 35 U.S.C. 154(b) by 0 days.

(21) Appl. No.: 18/326,352

(22) Filed: May 31, 2023

Related U.S. Application Data

(60) Provisional application No. 63/490,141, filed on Mar. 14, 2023.

(51) Int. Cl.

| | |
|---|---|
| ***F04D 29/00*** | (2006.01) |
| ***F04D 29/04*** | (2006.01) |
| ***F04D 29/052*** | (2006.01) |
| ***F04D 29/40*** | (2006.01) |
| *F04D 3/00* | (2006.01) |
| *F04D 13/06* | (2006.01) |
| *F04D 29/18* | (2006.01) |
| *F04D 29/52* | (2006.01) |
| *F04D 29/70* | (2006.01) |

(52) U.S. Cl.
CPC ..... *F04D 29/007* (2013.01); *F04D 29/04* (2013.01); *F04D 29/052* (2013.01); *F04D 29/406* (2013.01); *F04D 3/00* (2013.01); *F04D 13/06* (2013.01); *F04D 29/181* (2013.01); *F04D 29/528* (2013.01); *F04D 29/708* (2013.01)

(58) Field of Classification Search
CPC ..... F04D 29/007; F04D 29/052; F04D 29/04; F04D 29/52; F04D 29/648
See application file for complete search history.

(56) References Cited

U.S. PATENT DOCUMENTS 1,696,776 A * 12/1928 Menge ..... F04D 3/005 415/221
2,184,496 A * 12/1939 Hale ..... F04D 3/00 415/72

(Continued)

FOREIGN PATENT DOCUMENTS

| | | |
|---|---|---|
| EP | 1027543 A1 | 8/2000 |
| EP | 2295808 B1 | 11/2019 |
| NL | 1034150 C2 | 1/2009 |

*Primary Examiner* — Nathan C Zollinger
*Assistant Examiner* — Timothy P Solak

(57) ABSTRACT

An aeration pump system includes a tee fitting, an inlet pipe, an outlet pipe, and a pump assembly. The tee fitting includes a main body and a 90-degree curve channel traversing through the main body. The pump assembly includes a motor, a shaft, at least one peller, and a first-shaft stabilizer. The inlet and outlet pipes perpendicularly connect to the main body and are in fluid communication with each other through the 90-degree curve channel. The motor adjacently mounts to the main body and is diametrically opposed to the inlet pipe. The shaft operatively couples to the motor, which transfers rotational energy to the shaft. The first-shaft stabilizer terminally connects to the inlet pipe, opposite the main body. The at least one peller connects around the shaft and is positioned within the inlet pipe.

16 Claims, 12 Drawing Sheets

(56) References Cited

U.S. PATENT DOCUMENTS

| | | | | | |
|---|---|---|---|---|---|
| 2,881,707 | A * | 4/1959 | Thompson | F04D 3/00 | 415/143 |
| 3,093,156 | A * | 6/1963 | Nielsen | E03F 5/22 | 137/454.2 |
| 4,098,557 | A * | 7/1978 | Claunch | F04D 7/06 | 415/111 |
| 5,681,146 | A * | 10/1997 | White | F04D 29/181 | 416/223 R |
| 8,720,054 | B2 * | 5/2014 | Kobayashi | F04D 29/448 | 417/423.1 |
| 9,476,424 | B2 * | 10/2016 | Richter | F04D 25/0686 | |
| 10,882,593 | B1 * | 1/2021 | Ledford | F03D 1/06 | |
| 2015/0275855 | A1 | 10/2015 | Pal et al. | | |

* cited by examiner

AERATION PUMP SYSTEM WITH A 90-DEGREE ELBOW BETWEEN AN INLET AND AN OUTLET

The current application claims a priority to the U.S. provisional patent application Ser. No. 63/490,141 filed on Mar. 14, 2023.

FIELD OF THE INVENTION

The present invention generally relates to the flow and aeration of water and other circulation systems. More specifically, the present invention is a pump system that incorporates a peller and a novel tee fitting to maximize flow and aeration of liquid.

BACKGROUND OF THE INVENTION

The original design of a "Peller" [a term not defined in the dictionary but has the combine functionality of the Propeller and the Impeller] is patented to help control the source and quality of water in ponds and all other aquaculture environments that are increasingly in need of low head, high production, energy efficient, water circulation and aeration systems. Prior mechanisms and farm systems used different types of conventional types of pump devices for circulating the water into and out of the facilities in which the fish are raised. The existing pump devices such as a centrifugal impeller or other devices are normally used for these systems but are relatively expensive to operate and have high power requirements relative to the amount of water being pumped or circulated. Propellers and impellers both provide thrust but accomplish it in different ways but lacks efficiency in relation to flow and aeration of water.

An objective of the present invention is to provide a pump system with various inlet locations to allow water to effectively be pumped upwards through a pipe system that utilizes the Peller and a novel tee fitting. Although the Peller could be encased in circular housings having a vertical axis in which the Peller would be mounted for rotation on the central axis of the housing to pump water, the present invention incorporates a supportive structure and the novel tee fitting to increase the efficiency of the liquid flowing. Additionally, the use of the present invention can be used to move any liquid in any application and it is not restricted to water.

SUMMARY OF THE INVENTION

The present invention is a pump system to help with increasing the pumping efficiency of a Peller or any standard pump. The present invention seeks to provide users with a device that can enhance the movement of water or other liquids on large and smaller scales. In order to accomplish this the present invention comprises a pipe assembly and a motor assembly that creates a rotational force within the pipe assembly. Additionally, the present invention creates various locations for water or other liquids to enter into the pipe assembly as remaining components of the present invention control the flow and direction of water or other liquids. Thus, the present invention is a pump system that houses the Peller and other supportive structural components to increase the efficiency of the liquid flowing through the pipe assembly.

DETAIL DESCRIPTIONS OF THE INVENTION

All illustrations of the drawings are for the purpose of describing selected versions of the present invention and are not intended to limit the scope of the present invention.

Figure 1:
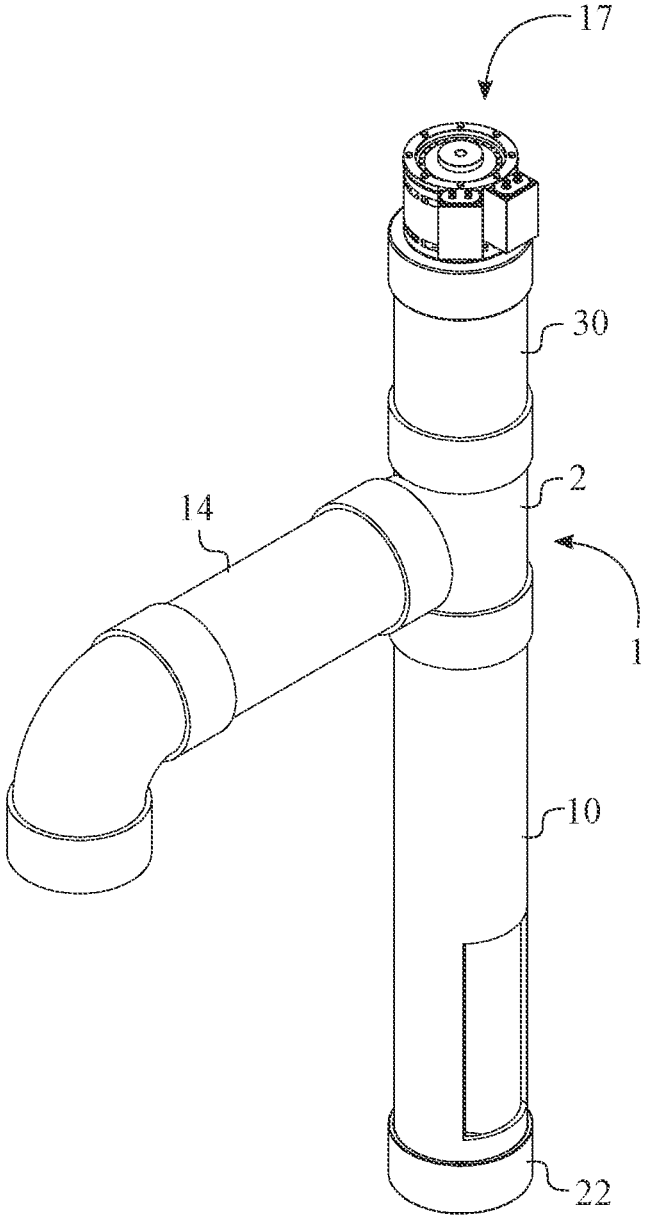
FIG. 1 is a perspective view of the present invention.
Figure 2:
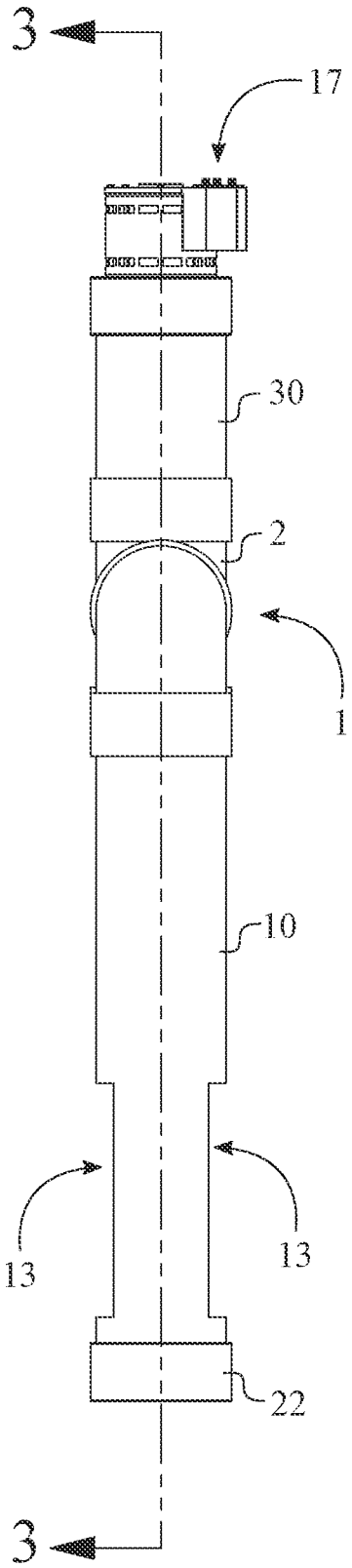
FIG. 2 is a front view of the present invention.
Figure 3:
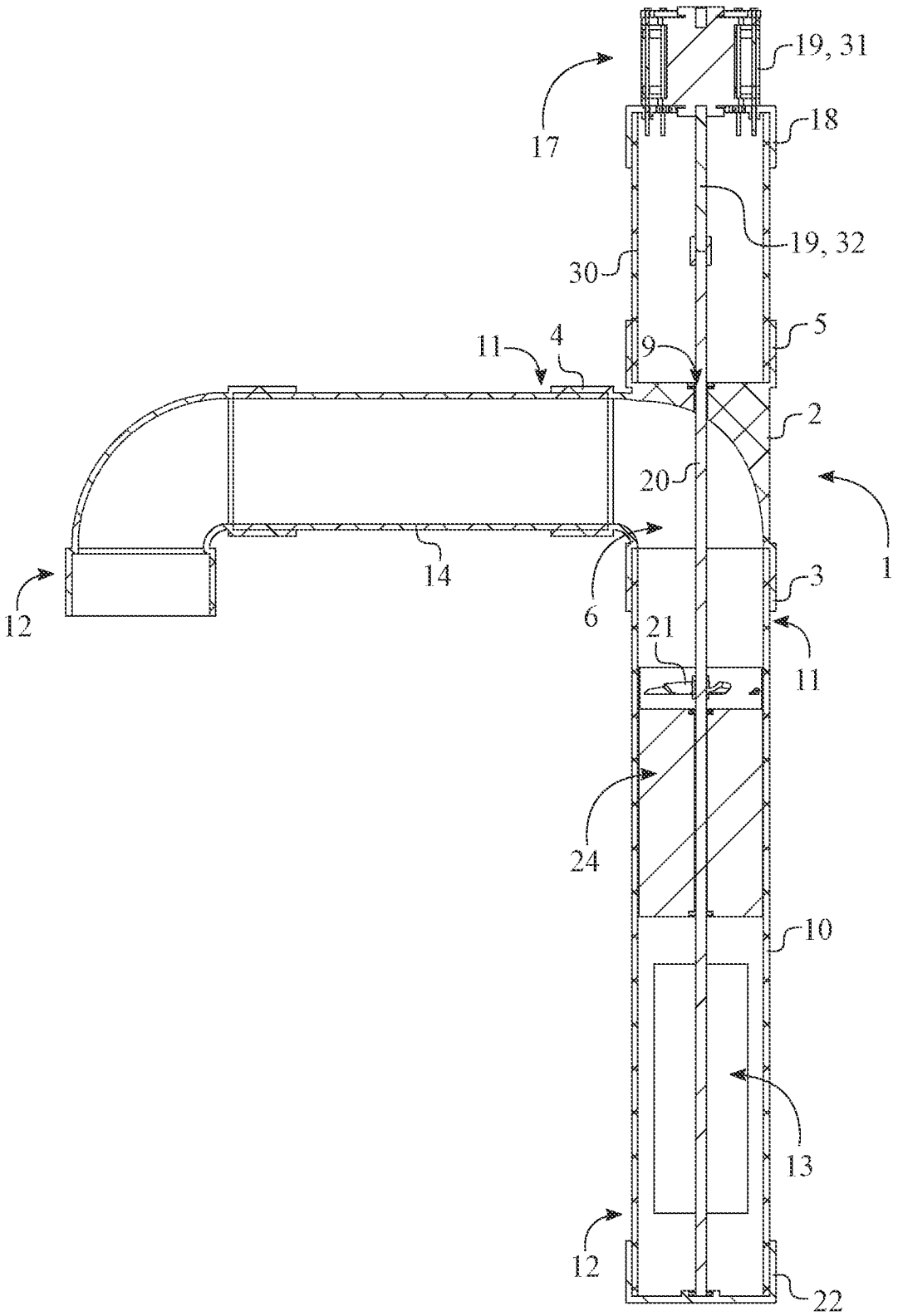
FIG. 3 is a cross-sectional view of the present invention taken along line 3-3 in FIG. 2, showing the at least one lateral opening.

The present invention is a pump system to improve flow and aeration of an aeration pump system with a 90-degree elbow between an inlet and an outlet. An objective of the present invention is to provide users with a pump system that moves liquid with a low head. The present invention intends to provide users with a pump system that moves water or other liquids without requiring high power amounts or large monetary funds for equipment. Even though the present invention is explained here in after in relation to a flow of water, the present invention can also be utilized to move other liquids without deviating from the scope of the invention. To accomplish the abovementioned features, the present invention comprises a tee fitting 1, an inlet pipe 10, an outlet pipe 14, and a pump assembly 17 as shown in FIG. 1. The tee fitting 1 that connects the inlet pipe 10 to the outlet pipe 14 comprises a main body 2 and a 90-degree curve channel 6 as shown in FIG. 2 and FIG. 3. The pump assembly 17 that drives the liquid through the inlet pipe 10, the tee fitting 1, and the outlet pipe 14 comprises a motor 19, a shaft 20, at least one peller 21, and a first shaft-stabilizer 22 as shown in FIG. 3.

In reference to the general configuration of the present invention, as shown in FIGS. 1-3, the 90-degree curve channel 6 traverses through the main body 2 so that water from inlet pipe 10 can be discharged into the outlet pipe 14. More specifically, the inlet pipe 10 is adjacently connected to the main body 2. The outlet pipe 14 is adjacently connected to the main body 2, wherein the outlet pipe 14 is positioned perpendicular to the inlet pipe 10. As a result, the outlet pipe 14 is in fluid communication with the inlet pipe 10 through the 90-degree curve channel 6. Collectively, the inlet pipe 10, the tee fitting 1, and the outlet pipe 14 form a tubular housing to drive water from one location to another. The motor 19 is adjacently mounted to the main body 2 and positioned diametrically opposed to the inlet pipe 10. The shaft 20 is operatively coupled to the motor 19 and oriented within the inlet pipe 10 in such a way that a rotational energy of the motor 19 can be transferred to the shaft 20. The first shaft-stabilizer 22 is terminally connected to the inlet pipe 10 and positioned opposite to the main body 2. In other words, the shaft 20 is engaged in between the motor 19 and the first shaft-stabilizer 22 as the shaft 20 rotatably traverses through the main body 2 and rotatably mounts to the first shaft-stabilizer 22. The at least one peller 21 is configured to act as both a propeller and an impeller as necessary for a particular water circulation requirement. The at least one peller 21 is perimetrically connected around the shaft 20 and positioned within the inlet pipe 10. For example, when the present invention is placed within a body of water, the rotational energy of the peller 21 is able to withdraw water into the inlet pipe 10 and drive water into the outlet pipe 14 through the tee fitting 1. A preferred embodiment of the peller 21 is described in U.S. patent Ser. No. 10/882,593.

Figure 4:
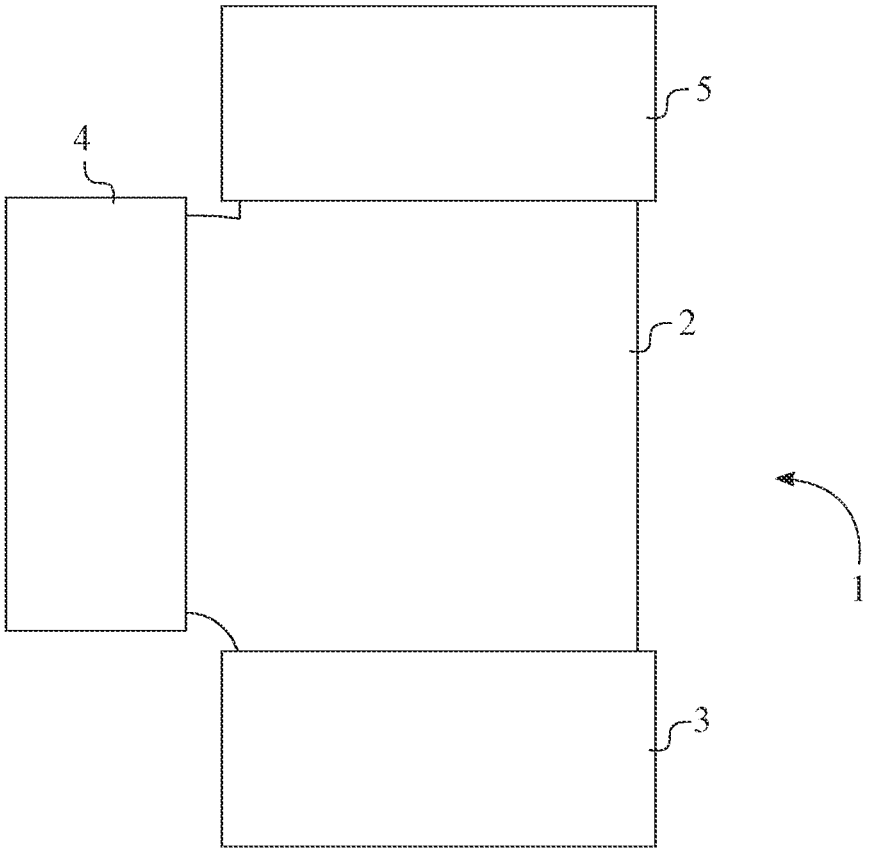
FIG. 4 is a side view of the tee fitting of the present invention.
Figure 5:
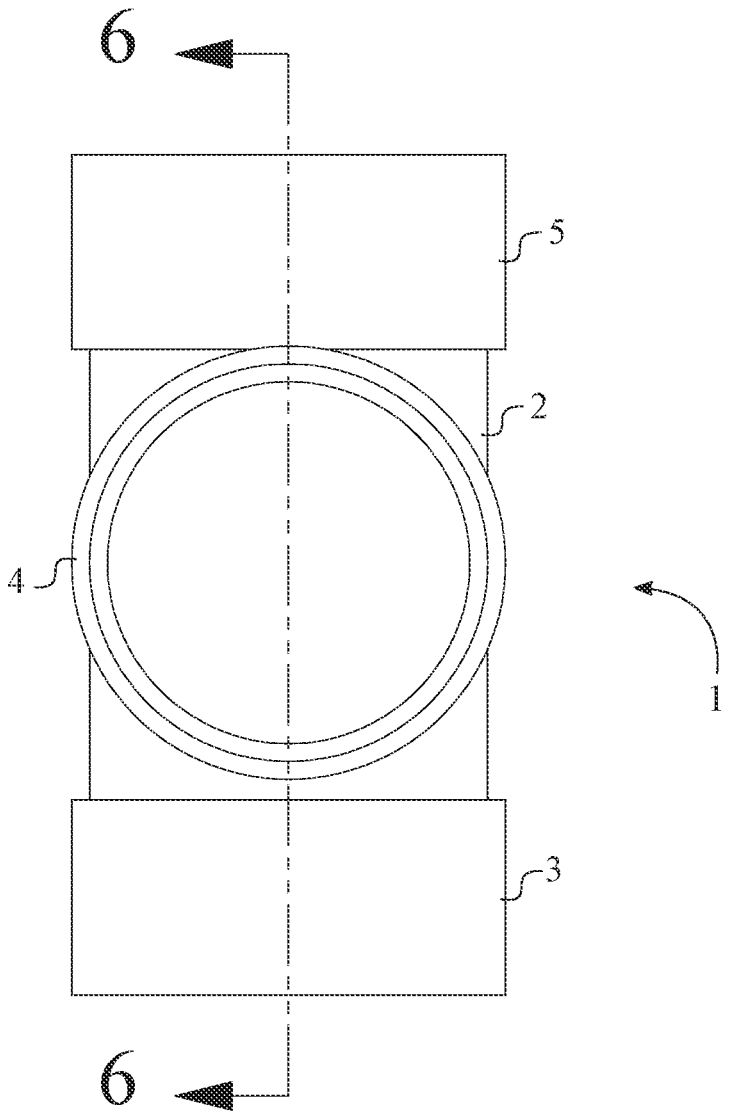
FIG. 5 is a front view of the tee fitting of the present invention.
Figure 6:
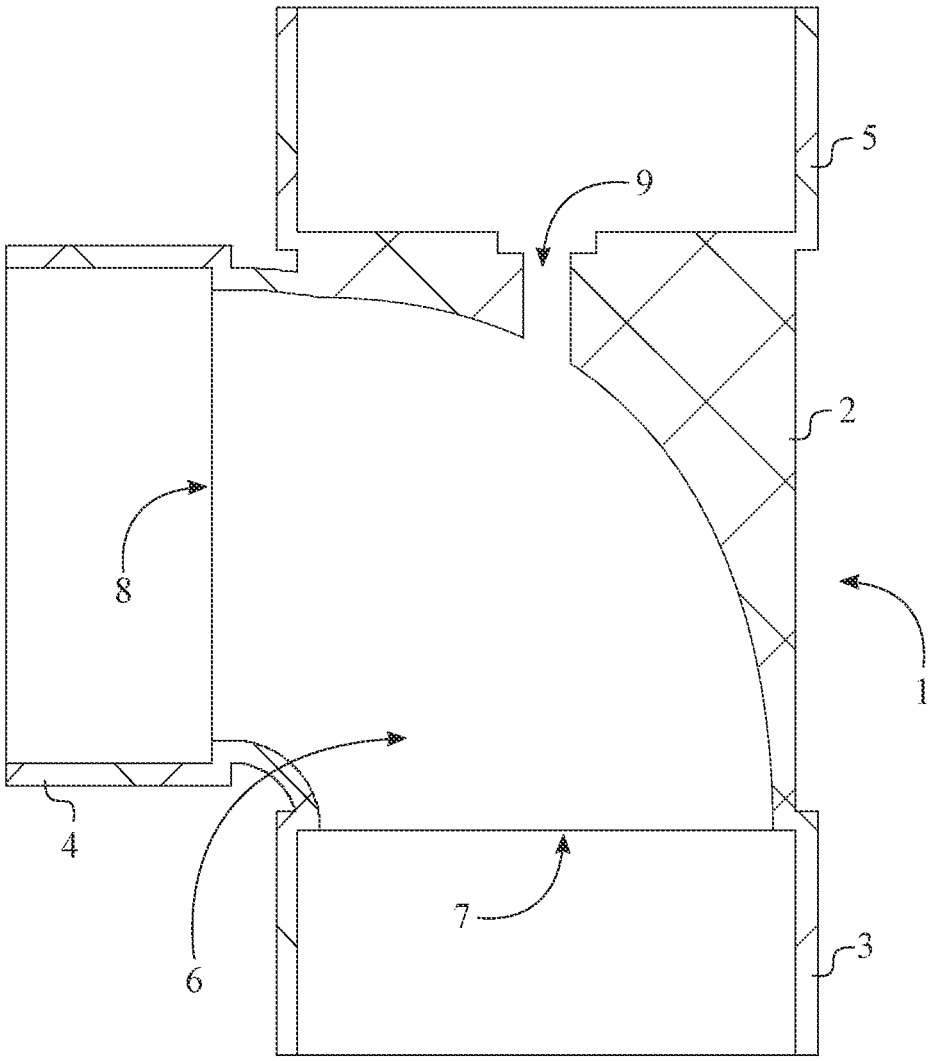
FIG. 6 is a cross-sectional view of the tee fitting of the present invention taken along line 6-6 in FIG. 5.

The tee fitting 1 functions as the intermediate body that connects the rest of the components of the present invention. More specifically, the exterior of the tee fitting 1 is formed into a T-shaped so that the inlet pipe 10, the outlet pipe 14, and the motor 19 can be connected from each sides. In reference to FIGS. 4-6, the tee fitting 1 may further comprise an inlet sleeve-connector 3, an outlet sleeve-connector 4, a pump connector 5, and a central hole 9 in addition to the main body 2 and the 90-degree curve channel 6. The inlet sleeve-connector 3 is adjacently connected to the main body 2 so that the inlet pipe 10 can be structurally connected to main body 2 via the inlet sleeve-connector 3. The pump connector 5 is diametrically opposed to the inlet sleeve-connector 3 and adjacently connected to the main body 2. Resultantly, the motor 19 can be mounted to the tee main body 2 via the pump connector 5 thus allowing the shaft 20 to be placed within the inlet pipe 10. The outlet sleeve-connector 4 is positioned perpendicular to the inlet sleeve-connector 3 and the pump connector 5 and adjacently connected to the main body 2 so that the outlet pipe 14 can be structurally connected to the main body 2 via the outlet sleeve-connector 4. The central hole 9 traverses into the 90-degree curve channel 6 through the main body 2 and concentrically positioned to the inlet sleeve-connector 3. As a result, the central hole 9 is able to provide a sufficient opening within the main body 2 to rotatably secure the shaft 20. In order to facilitate efficient flowing of water, an inlet opening 7 of the 90-degree curve channel 6 is concentrically positioned to the inlet sleeve-connector 3, and an outlet opening 8 of the 90-degree curve channel 6 is concentrically positioned to the outlet sleeve-connector 4.

In reference to FIG. 2 and FIG. 3, the inlet pipe 10 is the lower pipe that is located at the bottom of the tee fitting 1. The inlet pipe 10 is a cylindrical shape tubular body that allows water to flow upward while the least one peller 21 is operational. More specifically, the inlet pipe 10 is concentrically positioned to the inlet sleeve-connector 3 so that a proximal end 11 of the inlet pipe 10 is able internally connect to the inlet sleeve-connector 3. Furthermore, the first shaft-stabilizer 22 is concentrically connected to a distal end 12 of the inlet pipe 10 as the first shaft-stabilizer 22 is able to cap the distal end 12 of the inlet pipe 10. When the present invention is operational, the distal end 12 of the inlet pipe 10 is placed within the body of water so that water can be pumped into the inlet pipe 10.

In reference to FIG. 2 and FIG. 3, some embodiments of the present invention further comprise at least one lateral opening 13 that allows water to enter into the inlet pipe 10. The lateral opening 13 traverses into the inlet pipe 10, preferably as a rectangular opening, and positioned adjacent to the distal end 12. In other words, the lateral opening 13 allows water to enter into the inlet pipe 10 from the side as the first shaft-stabilizer 22 restricts water from entering into the inlet pipe 10 from the bottom.

Figure 7:
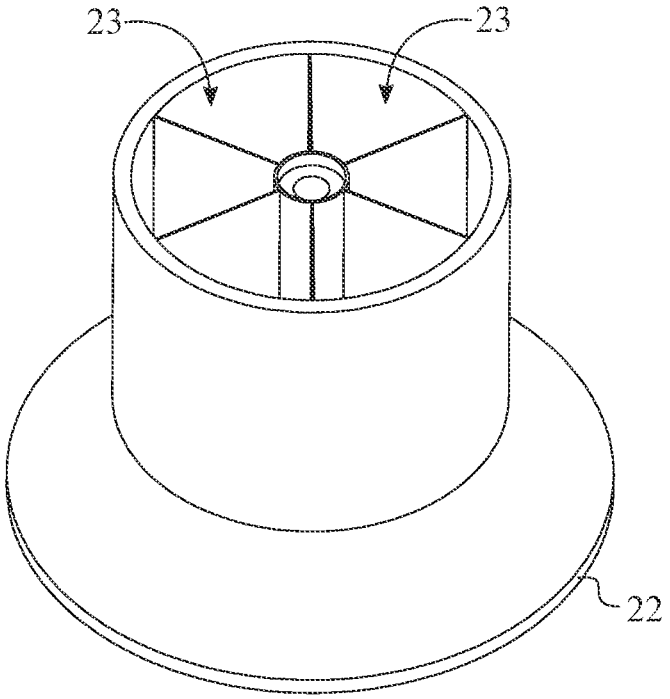
FIG. 7 is a perspective view of the first shaft-stabilizer, showing the plurality of bottom openings.
Figure 8:
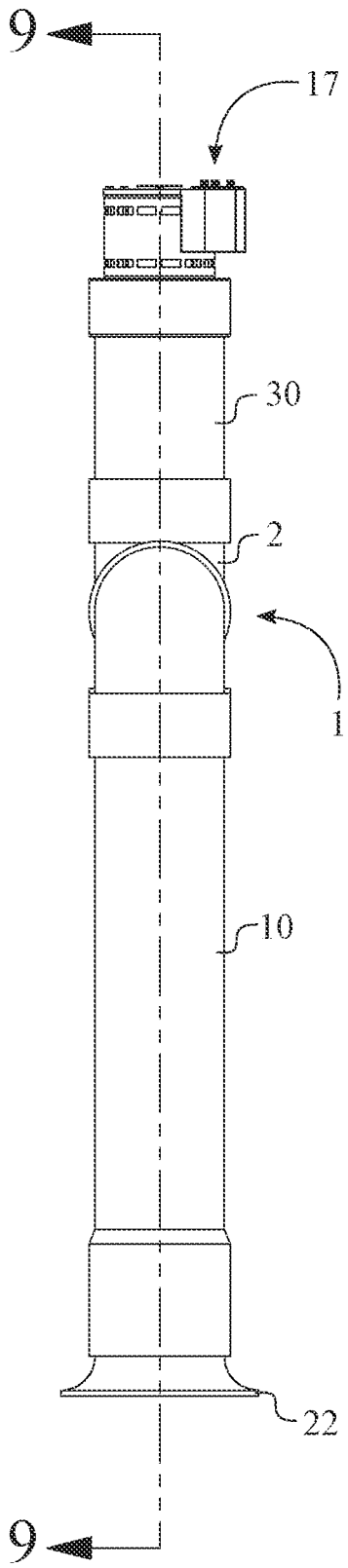
FIG. 8 is a front view of the present invention.
Figure 9:
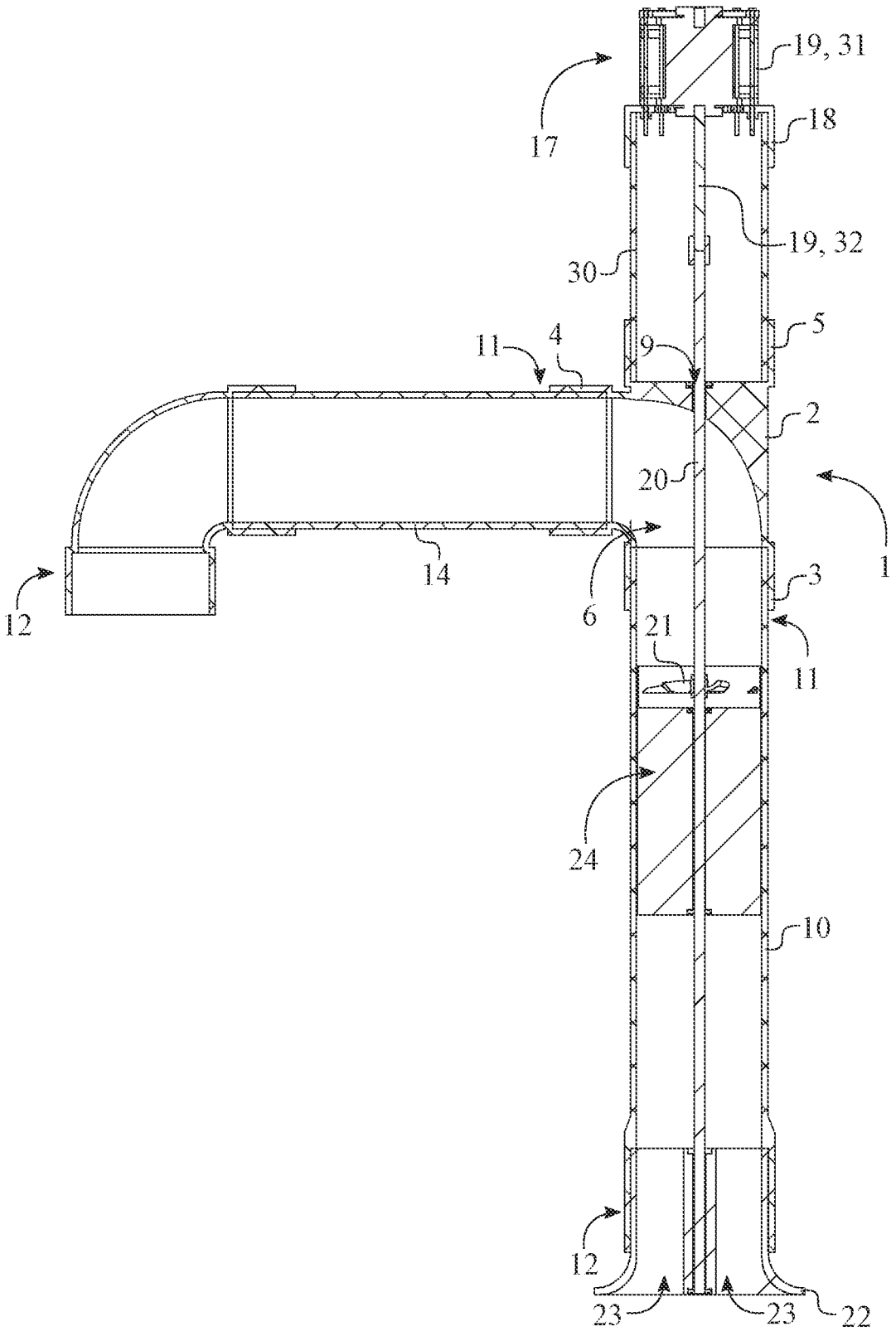
FIG. 9 is a cross-sectional view of the present invention taken along line 9-9 in FIG. 8, showing the plurality of bottom openings.
Figure 10:
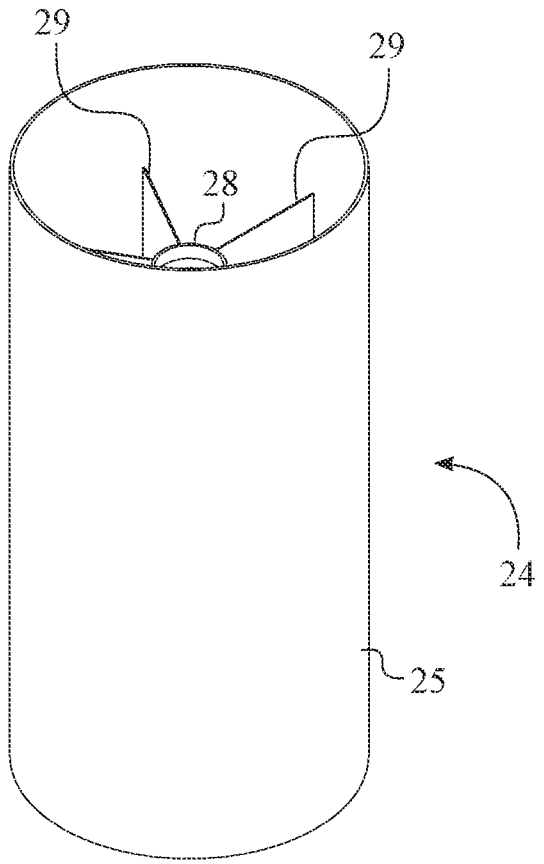
FIG. 10 is a perspective view of the second shaft-stabilizer of the present invention.
Figure 11:
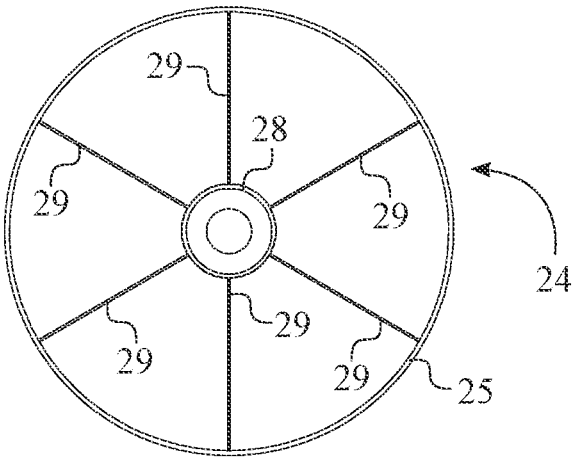
FIG. 11 is a top view of the second shaft-stabilizer of the present invention.
Figure 12:
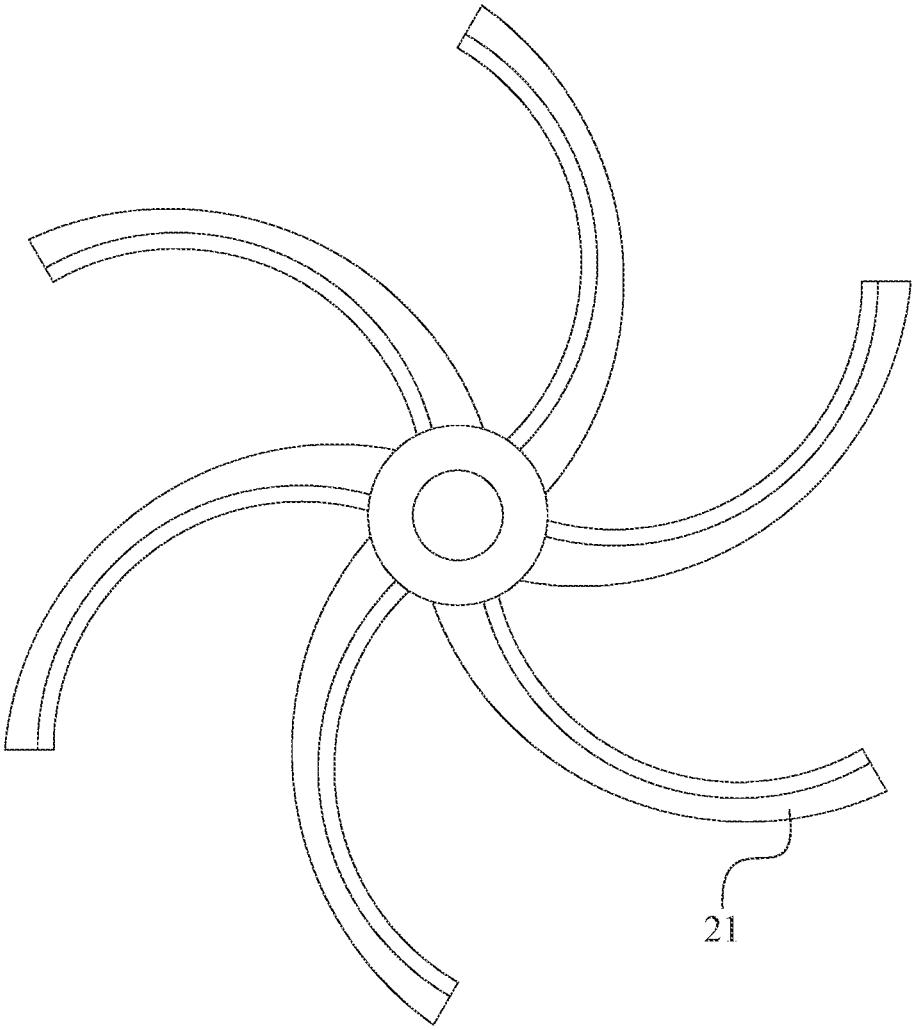
FIG. 12 is a top view of the peller of the present invention.

In reference to FIGS. 7-9, some embodiments of the present invention further comprise a plurality of bottom openings 23 that allow water to enter into the inlet pipe 10. The plurality of bottom openings 23 traverses the first shaft-stabilizer 22 and radially positioned the shaft 20. The plurality of bottom openings 23 positioned adjacent to the distal end 12 of the inlet pipe 10 thus creating a venturi effect through the first shaft-stabilizer 22. In other words, the plurality of bottom openings 23 allows water to enter into the inlet pipe 10 from the bottom as the first shaft-stabilizer 22 is connected to the distal end 12 of the inlet pipe 10.

In reference to FIG. 2 and FIG. 3, the outlet pipe 14 is the upper pipe that is laterally located to the tee fitting 1. The outlet pipe 14 is a cylindrical shape tubular body that allows water to be discharged while the least one peller 21 is operational. More specifically, the outlet pipe 14 is concentrically positioned to the outlet sleeve-connector 4 so that a proximal end 11 of the outlet pipe 14 is able internally connect to the outlet sleeve-connector 4. Furthermore, a distal end 12 of the outlet pipe 14 is positioned offset from the outlet sleeve-connector 4 thus allowing the water to be discharged away from the tee fitting 1. Preferably, the distal end 12 of the outlet pipe 14 is curved downward and towards the inlet pipe 10 to provide a controlled flow of water.

The pump functions as the mechanical device that generates the rotational energy within the present invention. In reference to FIG. 3 and FIGS. 10-12, the pump assembly 17 may further comprise a motor mount 18 and a second shaft-stabilizer 24 in addition to the motor 19, the shaft 20, the at least one peller 21, and the first shaft-stabilizer 22. The motor mount 18 is adjacently mounted to the pump connector 5 and functions as the mounting bracket in between the pump connector 5 and the motor 19. More specifically, a motor housing 31 of the motor 19 is attached to the motor mount 18 thus structurally securing the motor 19 to the tee fitting 1. A motor shaft 32 of the motor 19 is outwardly oriented from the motor mount 18 and towards the inlet pipe 10. The shaft 20 is attached to the motor shaft 32 so that the rotational energy of the shaft 20 can be transferred to the shaft 20. In order to maintain a rotational axis and reduce vibration, the shaft 20 is positioned within the central hole 9 and rotatably mounted to the main body 2.

Furthermore, the second shaft-stabilizer 24 is internally connected to the inlet pipe 10 so that the shaft 20 can be further stabilized and the water flow can be controlled. More specifically, the second shaft-stabilizer 24 may comprise an annular wall 25, a hub connector 28, and a plurality of lateral supports 29. The hub connector 28 is concentrically positioned within the annular wall 25 as the plurality of lateral supports 29 internally connects the hub connector 28 to the annular wall 25. Furthermore, the plurality of lateral supports 29 linearly extends from a bottom edge of the annular wall 25 and positioned offset from a top edge of the annular wall 25. In other words, a height of the annular wall 25 is greater than the height of the plurality of lateral supports 29 as the each of the plurality of lateral supports 29 ends before the top edge of the annular wall 25. Resultantly, the annular wall 25 is internally connected to the inlet pipe 10 thus internally connecting the second shaft-stabilizer 24 to the inlet pipe 10. The shaft 20 is rotatably mounted to the second shaft-stabilizer 24 as the shaft 20 concentrically traverses through the hub connector 28 and extends into the first shaft-stabilizer 22. The second shaft-stabilizer 24 also functions as a flow straightener as water travels through the plurality of lateral supports 29 to maximize the flow rate of the present invention. The at least one peller 21 is rotatably positioned within the second shaft-stabilizer 24 so that the water can be discharged into the tee fitting 1. More specifically, the at least one peller 21 is positioned in between the plurality of lateral support and the top edge of the annular wall 25 so that the at least one peller 21 can freely rotate within the annular wall 25. Even though the present invention is explained in relation to one peller 21 within the figures, the present invention can include multiple pellers 21 without deviating from the scope of the invention.

In reference to FIG. 3, the present invention may further comprise an extension pipe 30. The motor mount 18 is adjacently mounted to the pump connector 5 through the extension pipe 30. More specifically, the extension pipe 30 is a structural body that expands the distance between the motor mount 18 and the pump connector 5 so that the motor 19 can be positioned away from the body of water and safely mounted.

In reference to an alternative embodiment of the present invention, the motor mount 18 can also be mounted to the distal end 12 of the inlet pipe 10, and the first shaft-stabilizer 22 can be connected to the extension pipe 30 or the pump connector 5 wherein the motor 19 functions as a submersible pump. Resultantly, the motor 19 is in fluid communication with the inlet pipe 10 through the motor mount 18 so that water can be pumped into the inlet pipe 10.

Although the invention has been explained in relation to its preferred embodiment, it is to be understood that many other possible modifications and variations can be made without departing from the spirit and scope of the invention as hereinafter claimed.

What is claimed is:

1. An aeration pump system with a 90-degree elbow between an inlet and an outlet comprising:

a tee fitting;

an inlet pipe;

an outlet pipe;

a pump assembly;

the tee fitting comprising a main body and a 90-degree curve channel;

the pump assembly comprising a motor, a shaft, at least one peller, a first shaft-stabilizer, and a second shaft-stabilizer;

the 90-degree curve channel traversing through the main body;

a hydrodynamic internal surface of the 90-degree curve channel being configured for unobstructed non-turbulent fluid flow through a lumen of the 90-degree curve channel;

a perpendicular cross-section at each point along a central path through the 90-degree curve channel being a circular shape;

the inlet pipe being adjacently connected to the main body;

the outlet pipe being adjacently connected to the main body;

the outlet pipe being perpendicularly positioned to the inlet pipe;

the outlet pipe being in fluid communication with the inlet pipe through the 90-degree curve channel;

the motor being adjacently mounted to the main body;

the motor being diametrically opposed to the inlet pipe;

the shaft being operatively coupled to the motor, wherein a rotational energy of the motor is transferred to the shaft;

the first shaft-stabilizer being terminally connected to the inlet pipe, opposite of the main body;

the shaft rotatably traversing through the main body;

the shaft being rotatably mounted to the first shaft-stabilizer;

the at least one peller being laterally connected around the shaft;

the at least one peller being positioned within the inlet pipe;

the second shaft-stabilizer being internally connected to the inlet pipe;

the at least one peller being rotatably positioned within the second shaft-stabilizer; and the shaft being rotatably mounted to the second shaft-stabilizer.

2. The aeration pump system with a 90-degree elbow between an inlet and an outlet as claimed in claim 1 comprising:

the tee fitting further comprising an inlet sleeve-connector, an outlet sleeve-connector, a pump connector, and a central hole;

the inlet sleeve-connector being adjacently connected to the main body;

the pump connector being diametrically opposed of the inlet sleeve-connector;

the pump connector being adjacently connected to the main body;

the outlet sleeve-connector being positioned perpendicular to the inlet sleeve-connector and the pump connector;

the outlet sleeve-connector being adjacently connected to the main body;

the central hole traversing into the 90-degree curve channel through the main body;

the central hole being concentrically positioned to the inlet sleeve-connector;

an inlet opening of the 90-degree curve channel being concentrically positioned to the inlet sleeve-connector; and an outlet opening of the 90-degree curve channel being concentrically positioned to the outlet sleeve-connector.

3. The aeration pump system with a 90-degree elbow between an inlet and an outlet as claimed in claim 1 comprising:

the tee fitting further comprising an inlet sleeve-connector;

the inlet pipe being concentrically positioned to the inlet sleeve-connector;

a proximal end of the inlet pipe being internally connected to the inlet sleeve-connector; and the first shaft-stabilizer being concentrically connected to a distal end of the inlet pipe.

4. The aeration pump system with a 90-degree elbow between an inlet and an outlet as claimed in claim 3 comprising:

at least one lateral opening;

the lateral opening traversing into the inlet pipe; and the lateral opening being positioned adjacent to a distal end of the inlet pipe.

5. The aeration pump system with a 90-degree elbow between an inlet and an outlet as claimed in claim 3 comprising:

a plurality of bottom openings;

the plurality of bottom openings traversing through the first shaft-stabilizer;

the plurality of bottom openings radially positioned around the shaft; and the plurality of bottom openings being positioned adjacent to a distal end of the inlet pipe.

6. The aeration pump system with a 90-degree elbow between an inlet and an outlet as claimed in claim 1 comprising:

the tee fitting further comprising an outlet sleeve-connector;

the outlet pipe being concentrically positioned to the outlet sleeve-connector;

a proximal end of the outlet pipe being internally connected to the outlet sleeve-connector; and a distal end of the outlet pipe being positioned offset from the outlet sleeve-connector.

7. The aeration pump system with a 90-degree elbow between an inlet and an outlet as claimed in claim 1 comprising:

the tee fitting further comprising a pump connector and a central hole;

the pump assembly further comprising a motor mount;

the motor mount being adjacently mounted to the pump connector;

a motor housing of the motor being attached to the motor mount;

a motor shaft of the motor being outwardly oriented from the motor mount;

the shaft being attached to the motor shaft;

the shaft being positioned within the central hole; and the shaft being rotatably mounted to the main body.

8. The aeration pump system with a 90-degree elbow between an inlet and an outlet as claimed in claim 7 comprising:

an extension pipe; and the motor mount being adjacently mounted to the pump connector through the extension pipe.

9. The aeration pump system with a 90-degree elbow between an inlet and an outlet as claimed in claim 1 comprising:

the second shaft-stabilizer comprising a cylindrical annular wall, a hub connector, and a plurality of lateral supports;

an outer annular surface of the cylindrical annular wall and an inner annular surface of the cylindrical annular wall being positioned parallel to each other;

the hub connector being concentrically positioned within the cylindrical annular wall;

the hub connector being connected to the cylindrical annular wall by the plurality of lateral supports;

the plurality of lateral supports linearly extending from a bottom edge of the cylindrical annular wall;

the plurality of lateral supports being positioned offset from a top edge of the cylindrical annular wall; and the at least one peller being positioned in between the top edge of the cylindrical annular wall and the plurality of lateral supports.

10. An aeration pump system with a 90-degree elbow between an inlet and an outlet comprising:

a tee fitting;

an inlet pipe;

an outlet pipe;

a pump assembly;

the tee fitting comprising a main body, a 90-degree curve channel, a pump connector, and a central hole;

the pump assembly comprising a motor, a shaft, at least one peller, a first shaft-stabilizer, a second shaft stabilizer, and a motor mount;

the second shaft-stabilizer comprising a cylindrical annular wall, a hub connector, and a plurality of lateral supports;

the 90-degree curve channel traversing through the main body;

a hydrodynamic internal surface of the 90-degree curve channel being configured for unobstructed non-turbulent fluid flow through a lumen of the 90-degree curve channel;

a perpendicular cross-section at each point along a central path through the 90-degree curve channel being a circular shape;

the inlet pipe being adjacently connected to the main body;

the outlet pipe being adjacently connected to the main body;

the outlet pipe being perpendicularly positioned to the inlet pipe;

the outlet pipe being in fluid communication with the inlet pipe through the 90-degree curve channel;

the motor being adjacently mounted to the main body;

the motor being diametrically opposed to the inlet pipe;

the shaft being operatively coupled to the motor, wherein a rotational energy of the motor is transferred to the shaft;

the first shaft-stabilizer being terminally connected to the inlet pipe, opposite of the main body;

the shaft rotatably traversing through the main body;

the shaft being rotatably mounted to the first shaft-stabilizer;

the second shaft-stabilizer being internally connected to the inlet pipe;

the shaft being rotatably mounted to the second shaft-stabilizer;

the at least one peller being rotatably positioned within the second shaft-stabilizer;

the at least one peller being laterally connected around the shaft;

the at least one peller being positioned within the inlet pipe;

the motor mount being adjacently mounted to the pump connector;

a motor housing of the motor being attached to the motor mount;

a motor shaft of the motor being outwardly oriented from the motor mount;

the shaft being attached to the motor shaft;

the shaft being positioned within the central hole;

the shaft being rotatably mounted to the main body;

an outer annular surface of the cylindrical annular wall and an inner annular surface of the cylindrical annular wall being positioned parallel to each other;

the hub connector being concentrically positioned within the cylindrical annular wall;

the hub connector being connected to the cylindrical annular wall by the plurality of lateral supports;

the plurality of lateral supports linearly extending from a bottom edge of the cylindrical annular wall;

the plurality of lateral supports being positioned offset from a top edge of the cylindrical annular wall; and the at least one peller being positioned in between the top edge of the cylindrical annular wall and the plurality of lateral supports.

11. The aeration pump system with a 90-degree elbow between an inlet and an outlet as claimed in claim 10 comprising:

the tee fitting further comprising an inlet sleeve-connector, an outlet sleeve-connector, and a pump connector;

the inlet sleeve-connector being adjacently connected to the main body;

the pump connector being diametrically opposed of the inlet sleeve-connector;

the pump connector being adjacently connected to the main body;

the outlet sleeve-connector being positioned perpendicular to the inlet sleeve-connector and the pump connector;

the outlet sleeve-connector being adjacently connected to the main body;

the central hole traversing into the 90-degree curve channel through the main body;

the central hole being concentrically positioned to the inlet sleeve-connector;

an inlet opening of the 90-degree curve channel being concentrically positioned to the inlet sleeve-connector; and an outlet opening of the 90-degree curve channel being concentrically positioned to the outlet sleeve-connector.

12. The aeration pump system with a 90-degree elbow between an inlet and an outlet as claimed in claim 10 comprising:

the tee fitting further comprising an inlet sleeve-connector;

the inlet pipe being concentrically positioned to the inlet sleeve-connector;

a proximal end of the inlet pipe being internally connected to the inlet sleeve-connector; and the first shaft-stabilizer being concentrically connected to a distal end of the inlet pipe.

13. The aeration pump system with a 90-degree elbow between an inlet and an outlet as claimed in claim 12 comprising:

at least one lateral opening;

the lateral opening traversing into the inlet pipe; and the lateral opening being positioned adjacent to a distal end of the inlet pipe.

14. The aeration pump system with a 90-degree elbow between an inlet and an outlet as claimed in claim 12 comprising:

a plurality of bottom openings;

the plurality of bottom openings traversing through the first shaft-stabilizer;

the plurality of bottom openings radially positioned around the shaft; and the plurality of bottom openings being positioned adjacent to a distal end of the inlet pipe.

15. The aeration pump system with a 90-degree elbow between an inlet and an outlet as claimed in claim 10 comprising:

the tee fitting further comprising an outlet sleeve-connector;

the outlet pipe being concentrically positioned to the outlet sleeve-connector;

a proximal end of the outlet pipe being internally connected to the outlet sleeve-connector; and a distal end of the outlet pipe being positioned offset from the outlet sleeve-connector.

16. The aeration pump system with a 90-degree elbow between an inlet and an outlet as claimed in claim 10 comprising:

an extension pipe; and the motor mount being adjacently mounted to the pump connector through the extension pipe.

* * * * *